United States Patent [19]

Lang et al.

[11] Patent Number: 4,541,366

[45] Date of Patent: Sep. 17, 1985

[54] FEED WATER PREHEATER

[75] Inventors: Helmut V. Lang, Wettingen; Son LeMong, Baden, both of Switzerland

[73] Assignee: BBC Brown, Boveri & Company, Limited, Baden, Switzerland

[21] Appl. No.: 603,314

[22] Filed: Apr. 24, 1984

[30] Foreign Application Priority Data

Apr. 29, 1983 [CH] Switzerland ..... 2308/83

[51] Int. Cl.[4] ..... F22D 1/28

[52] U.S. Cl. ..... 122/441; 165/114

[58] Field of Search ..... 122/441, 1 C, 442, 443; 165/114, 113, 112

[56] References Cited

U.S. PATENT DOCUMENTS

| | | | |
|---|---|---|---|
| 3,795,273 | 3/1974 | Brigida et al. | 122/441 X |
| 4,249,485 | 2/1981 | Brul et al. | 122/441 |
| 4,461,244 | 7/1984 | Riegger et al. | 122/441 |
| 4,461,346 | 7/1984 | Hoshino et al. | 122/441 X |

*Primary Examiner*—Edward G. Favors

*Attorney, Agent, or Firm*—Burns, Doane, Swecker & Mathis

[57] ABSTRACT

In a feed water preheater of horizontal type with an integrated desuperheater, the last deflection chamber of the desuperheater is provided with lateral steam outlet ports (13). As a result, the desuperheated steam does not reach the condensation zone directly as hitherto by passing into the free cross-section of the tube bundle but, instead, it passes into the free space surrounding the condensation bundle (2) on which it can then act from the outside inwards at minimum flow velocity.

4 Claims, 4 Drawing Figures

FEED WATER PREHEATER

FIELD OF INVENTION

The present invention relates to a feed water preheater of the horizontal type.

BACKGROUND OF THE INVENTION

In thermal power stations, the feed water is heated stepwise in preheaters before it enters the steam generator. These preheaters can be either the vertical type or the horizontal type. When superheated steam is introduced into the feed water preheater, a part of the superheat can be thermodynamically utilised in a desuperheater, if the steam is sufficiently superheated. The steam is introduced into the desuperheater through a branch directed to the tube bundles and is passed around the tube bundles in a counter-current fashion and thus heats the feed water flowing in the tubes by convection. In desuperheaters of the horizontal type, the bleed steam is passed, depending on the degree of superheat, at high velocity in the axial direction of the preheater through one or more chambers arranged in the desuperheater and then flows into the condensation zone of the preheater. Due to the flow losses suffered by the steam while passing through the desuperheater until it leaves the latter, the steam pressure in the condensation part of the preheater is substantially lower than at the desuperheater inlet.

In the known designs of horizontal preheaters, the steam outlet ports are arranged on the end face of the desuperheater which faces the condensation zone or are arranged on the last desuperheater support plate. At this point, some of the preheated tubes are not supported, and the steam flows through the outlet ports directly onto the condensation tubes and along them.

In this way, a crossflow results between the steam leaving the desuperheater and the condensate dropping off from the condensation tubes, whereby, in particular at high steam velocities, the condensate is entrained by the steam and whirled against the condensation tubes. This action can cause erosion/corrosion damage to the condensation tubes.

SUMMARY OF THE INVENTION

It is the object of the invention to provide a desuperheater design in which the risk of erosion/corrosion damage due to steam flowing directly onto the condensation tubes is avoided.

The abovementioned object is achieved by a feed water preheater constructed according to the invention as described below.

BRIEF DESCRIPTION OF THE DRAWINGS

Two preferred embodiments of the invention are diagrammatically shown in the drawing in which.

Elements which are not essential to the invention, such as, for example, the water chambers, support plates and the like, are not shown. The direction of flow of the heating steam is indicated by arrows.

DETAILED DESCRIPTION OF THE PREFERRED EMBODIMENTS

The preferred embodiments each show a horizontal preheater with a built-in desuperheater at the feed water outlet and a flooded condensate sub-cooler at the feed-water inlet.

Figure 1:
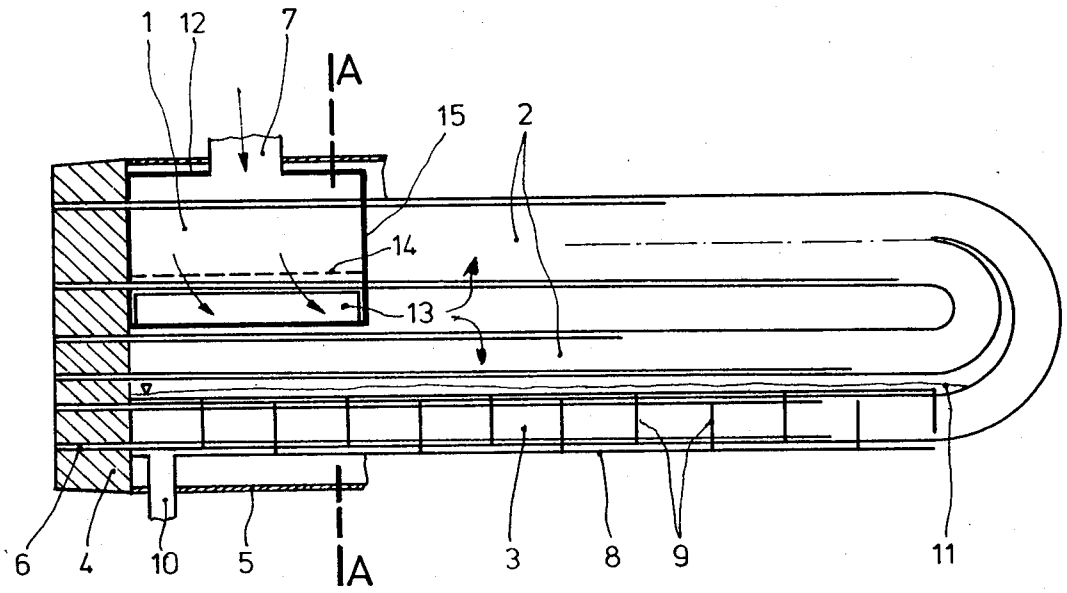
FIG. 1 shows a longitudinal section through a feed water preheater with an odd number of chambers in the desuperheater.
Figure 1A:
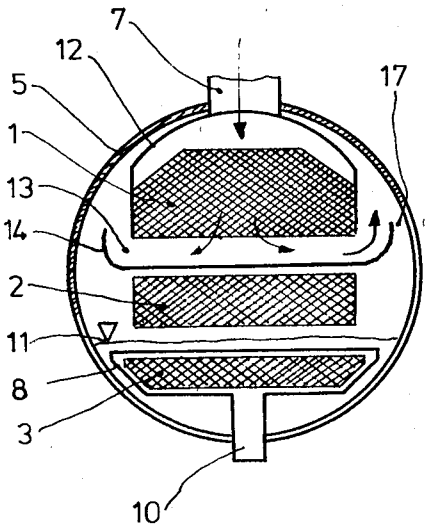
FIG. 1*a* shows a cross-section through the preheater along the line A—A in FIG. 1.
Figure 2:
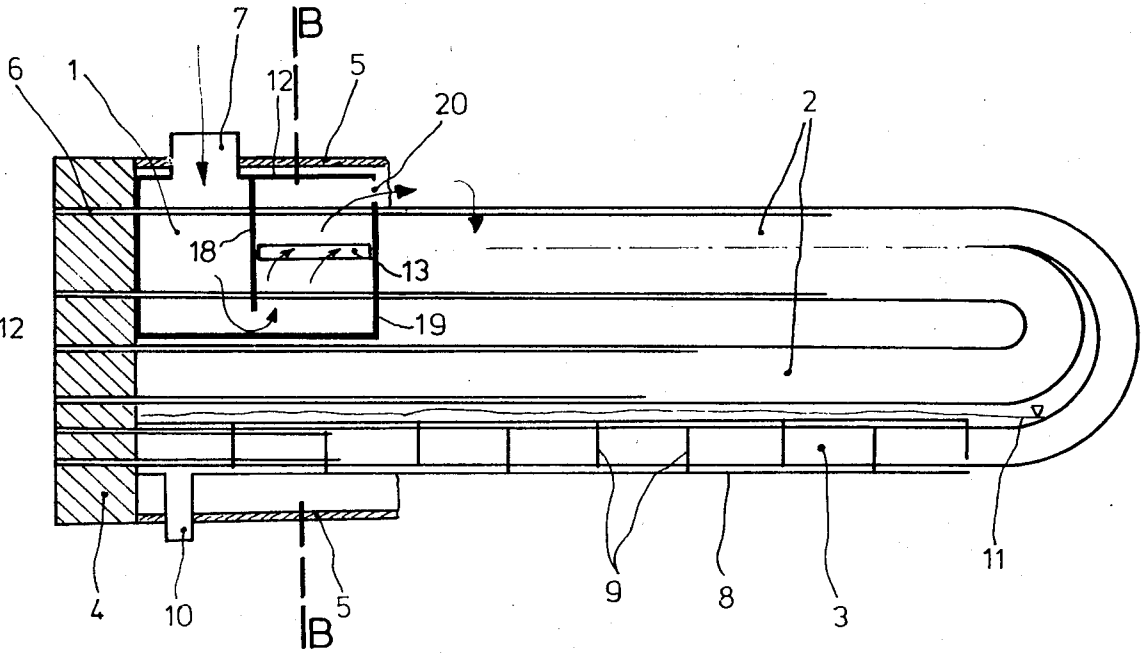
FIG. 2 shows a longitudinal section through the feed water preheater with an even number of chambers in the desuperheater.
Figure 2A:
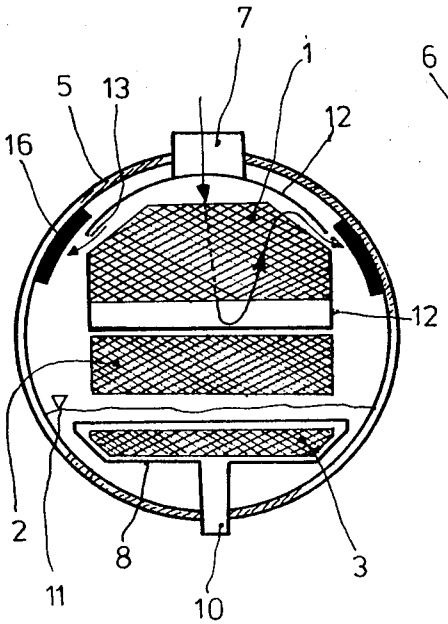
FIG. 2*a* shows a cross-section through the preheater along the line B—B in FIG. 2.

In the cross-sections of FIGS. 1*a* and 2*a*, the desuperheater bundles are designated 1, the condensation bundles are designated 2 and the sub-cooling bundles are marked 3. A steam shell 5, only parts of which are shown, is placed over the tube bundles. The individual tubes 6 are combined to form the said bundles are welded into the tube plate 4.

The actual desuperheater is formed by a sheet metal casing 12 which is closed on all sides and, on its upper side, carries the steam inlet 7. The sub-cooling bundle 3 is surrounded on all sides by a sub-cooling shell 8. The latter is subdivided by means of baffles 9 into individual chambers, the last of which carries the condensate outlet 10. The cooler is flooded, and the condensate level is designated 11. In the desuperheater, the superheated bleed steam is passed at a defined velocity in crossflow and counter-current relationship to the feed water and releases its superheat there. To ensure that that point at which the outer walls of the tubes reach the local saturation temperature is not located within the desuperheater, so that condensation would start, the size of the desuperheater must be correctly chosen. This has the result that, depending on the desuperheater size, the required number of chambers and hence the number of steam deflections is even or odd. This is the deciding factor for the structural design of the transition from the desuperheating zone to the condensation zone.

FIGS. 1 and 1*a* then show the solution according to the invention, as it results for an odd number of chambers. For the sake of simplicity, only a single chamber is shown; it is to be understood, however, that the same solution which always relates only to the last of the desuperheating chambers is also applied for three or five chambers.

The sheet metal casing 12 which is closed on all sides and surrounds the desuperheater is provided in the last chamber with lateral steam outlet ports 13 which extend over the entire chamber length. These ports 13 are located below the desuperheater bundle 1 since, with the steam (7) entering the first chamber at the top and with an odd number of chambers, there is also downward flow in the last chamber. In order to prevent the steam emerging laterally from them flowing against the steam shell 5 on the one hand and whipping up the stagnant condensate (11) on the other hand, the outlet ports 13 are adjoined by baffles 14. These baffles 14 which are supported in a suitable manner in the steam space, lead the steam axially into the condensation zone. For this purpose, their axial extent can be slightly greater than the outlet ports 13, that is to say they can reach beyond the last deflection chamber into the condensation zone. At the end support plate 15 of the desuperheater, only a small steam rate flows though the annular gaps between the tubes 6 and the plate holes and thus passes in the direction along the tubes into the free cross-section of the tube array. The major part of the steam flows into the free space around the condensation bundle 2, through which it can then flow from the outside inwards at minimum velocity. The baffles 14 are at a certain distance 17 from the steam shell 5. As a result, a part of the steam can flow around the baffle 14 and act on those parts of the condensation bundle 2 which are located directly below the bottom face of the desuperheater casing 12.

FIGS. 2 and 2*a* show that solution which is used for an even number of deflection chambers. A desuperheater is shown which is subdivided by means of a baffle 18 into two chambers.

If the inflow into the first chamber is downwards or from the outside inwards, the cross flow through the desuperheater bundle 1 in the last chamber is here, respectively, upwards or from the inside outwards. Correspondingly, all the steam should be discharged above the tube bundle 1.

According to the invention, the sheet metal casing 12, closed on all sides, in the rearmost chamber is then here also provided with lateral steam outlet ports 13 which, in the example shown, extend over almost the entire chamber length. Furthermore, this also makes it possible to interrupt the end support plate 19 directly above the tube bundle. Together with the curved upper part of the sheet metal casing 12, the support plate 19 thus forms a further outlet port 20 for the desuperheated steam. To prevent erosion of the steam shell 5, those parts of the preheater shell which are located opposite the lateral ports 13 are faced with plated sheets 16.

What is claimed is:

1. A feed water preheater of horizontal type provided with a steam shell and a built-in desuperheater, the preheater including a sheet metal casing and a baffle arrangement which divides said casing into deflection chambers in which steam flows across desuperheater bundles to be desuperheated prior to introduction of the steam into a condensation zone defined by a bundle of condensate tubes the improvement comprising, steam outlet ports provided in one of the deflection chambers and extending over the entire chamber length along sides of the sheet metal casing.

2. Feed water preheater according to claim 1, wherein, for an odd number of the deflection chambers, a baffle adjoins each of the steam outlet ports, the baffle extends a small lateral distance from the steam shell and extends over at least the same length as the ports.

3. Feed water preheater according to claim 1, wherein, for an even number of the deflection chambers, plated sheets of an erosion-resistant material are arranged opposite the outlet ports.

4. Feed water preheater according to claim 1, wherein, for an even number of the deflection chambers, an end support plate of the desuperheater is interrupted above the desuperheater bundle and, together with an upper part of the sheet metal casing, forms an outlet port for desuperheated steam.

* * * * *